US005160198A

United States Patent [19]

Fillon

[11] Patent Number: 5,160,198

[45] Date of Patent: Nov. 3, 1992

[54] MODULAR STRUCTURE CABINET FOR STIRRERS OF PAINTS AND SIMILAR PRODUCTS

[75] Inventor: Roger Fillon, Rambouillet, France

[73] Assignee: Fillon-Pichon S.A., Yvelines, France

[21] Appl. No.: 798,367

[22] Filed: Nov. 21, 1991

Related U.S. Application Data

[63] Continuation of Ser. No. 552,899, Jul. 16, 1990, abandoned.

[30] Foreign Application Priority Data

Jul. 18, 1989 [FR] France ..... 89 09640

[51] Int. Cl.[5] ..... B01F 7/20

[52] U.S. Cl. ..... 366/198; 312/198; 366/249; 366/605

[58] Field of Search ..... 366/297, 291, 197, 198, 366/241, 242, 244, 245, 247, 248, 249, 250, 251, 605; 312/198, 223; 211/71, 74

[56] References Cited

U.S. PATENT DOCUMENTS

| | | | |
|---|---|---|---|
| 1,509,276 | 9/1924 | Wartel | 366/198 |
| 1,842,938 | 1/1932 | Hancock | 366/251 |
| 2,068,646 | 1/1937 | Hexter | 366/605 X |
| 2,333,951 | 11/1943 | O'Neill | 366/605 X |
| 2,428,492 | 10/1947 | Haller | 366/251 |
| 2,603,461 | 7/1952 | Marienthal | 366/605 X |
| 2,757,910 | 8/1956 | O'Neill | 366/247 |
| 2,802,649 | 8/1957 | Stockton | 366/605 X |
| 2,819,885 | 1/1958 | Baechle | 366/605 X |
| 2,910,277 | 10/1959 | Brown | 366/197 |
| 2,965,363 | 12/1960 | Worden | 366/605 X |
| 2,985,587 | 5/1961 | Hoch et al. | 366/197 X |
| 3,118,653 | 1/1964 | Dedoes | 366/251 X |
| 4,225,248 | 9/1980 | Para | 366/251 |
| 4,299,500 | 11/1981 | Bassetti | 366/198 |
| 4,445,782 | 5/1984 | Sparrow, Jr. | 366/605 X |
| 4,497,581 | 2/1985 | Miller | 366/605 X |
| 5,017,017 | 5/1991 | Godat et al. | 366/605 X |

FOREIGN PATENT DOCUMENTS

| | | | |
|---|---|---|---|
| 127589 | 12/1984 | European Pat. Off. | 366/605 |
| 143145 | 6/1985 | European Pat. Off. | 312/223 |
| 858607 | 12/1952 | Fed. Rep. of Germany | 366/197 |
| 2102417 | 4/1972 | France | 366/198 |

OTHER PUBLICATIONS

A.P.C. Application of O. A. Becker, Serial No. 273,370, published Apr. 27, 1943.

*Primary Examiner*—Harvey C. Hornsby
*Assistant Examiner*—C. Cooley
*Attorney, Agent, or Firm*—Larson & Taylor

[57] ABSTRACT

Each of the modules comprises a base or case with cells been mounted thereon. Each of the cells comprises two vertical panels connected by a plate containing a mechanism for driving coupling members which are complementary to coupling members comprised by the can stirrers. One of the cells at least is provided with a motor reducing unit simultaneously connected to horizontal and vertical movement transmitting units provided for connecting together the motor reducing unit and the various coupling members.

14 Claims, 4 Drawing Sheets

MODULAR STRUCTURE CABINET FOR STIRRERS OF PAINTS AND SIMILAR PRODUCTS

This application is a continuation of application Ser. No. 07/552,899 filed Jul. 16, 1990, now abandoned.

FIELD OF THE INVENTION

This invention relates to cabinets provided to contain paint packaged in cans having a cover which is provided with a stirrer.

BACKGROUND OF THE INVENTION

Cabinets of this type are used, in particular in the car body making industry for enabling to have paints making possible to obtain mixtures corresponding to the exact color of a paint to be sprayed, for example, on a repaired vehicle.

According to the size or speciality of the company using these cabinets, the cabinets for stirrer cans must have different capacity.

The invention relates to the manufacturing of these cabinets and, more particularly, a manufacturing in a modular structure making possible a mass production of cabinets having very different capacities and able to be adapted at the place of use.

KNOWN ART AND SUMMARY OF THE INVENTION

It should be appreciated that the present invention is directed to solving a specific problem. This problem was how to make a general paint mixing cabinet which could be arranged to accommodate almost any possible layout of a building in which the paint mixing cabinet was to be used. In particular, the present invention is usable with buildings having unusual configurations (such as an angular configuration), and also with buildings or areas having various ceiling heights (such as a low ceiling area where other uses of the area would not be practicable).

A paint mixing cabinet has already been disclosed in French Patent 2,102,417, the inventor Fillon of which is the same as the inventor of the present application, and the inventor did specifically start with this prior art in mind.

However, the problem solved by French Patent 2,102,417 to Fillon was how to make an apparatus with a plurality of compartments and how to simultaneously drive the various levels of such a standard apparatus. In solving this problem, French Patent 2,102,417 to Fillon discloses a prior art paint mixing cabinet of fixed size which does solve the problem addressed. However, the teachings of this patent do not address a completely unrelated problem, which is how to accommodate for specific building configurations and ceiling heights.

According to the invention, the modular structure cabinet for stirrers of paints and similar products packaged in cans is characterized in that it comprises at least one module, each module comprising a base or case with superimposed cells being mounted thereon on which the cans are placed, each of the cells comprising two panels connected by a plate containing a mechanism for driving coupling members which are complementary to coupling members comprised by the can stirrers, one of these cells at least being provided with a motor reducing unit, this motor reducing unit being simultaneously connected to horizontal and vertical movement transmitting units provided for connecting together the motor reducing unit and the coupling members for the cells.

The present invention thus makes use of stackable or modular cells in a module. The use of such stackable or modular cells serves to solve the problem of limited ceiling height, because as many modular cells of the present invention can be superimposed as will be accommodated by the limited ceiling height present.

On the other hand, French patent 2,102,417 to Fillon discloses a fixed series (set number) of shelves, all sharing a back panel as well as two side panels, and does not disclose a plurality of superposed modular cells. In fact, this patent teaches that a single self-contained paint cabinet is usable for the storage of a number of cans, the number depending on the size of the cabinet.

Various other features of the invention will moreover be revealed from the following detailed disclosure.

BRIEF DESCRIPTION OF THE DRAWINGS

Embodiments of the invention are shown, as non limitative examples, in the accompanying drawings, wherein:

FIG. 3*a* is an elevation view of a portion of the assembled transmitter mechanism depicted in FIG. 3;

FIG. 3*b* is an top plan view of another portion of the assembled transmitter mechanism depicted in FIG. 3;

FIG. 4*a* is an elevation view of a portion of the assembled transmitter mechanism depicted in FIG. 4;

FIG. 4*b* is an top plan view of another portion of the assembled transmitter mechanism depicted in FIG. 4;

DESCRIPTION OF PREFERRED EMBODIMENTS

Figure 1:
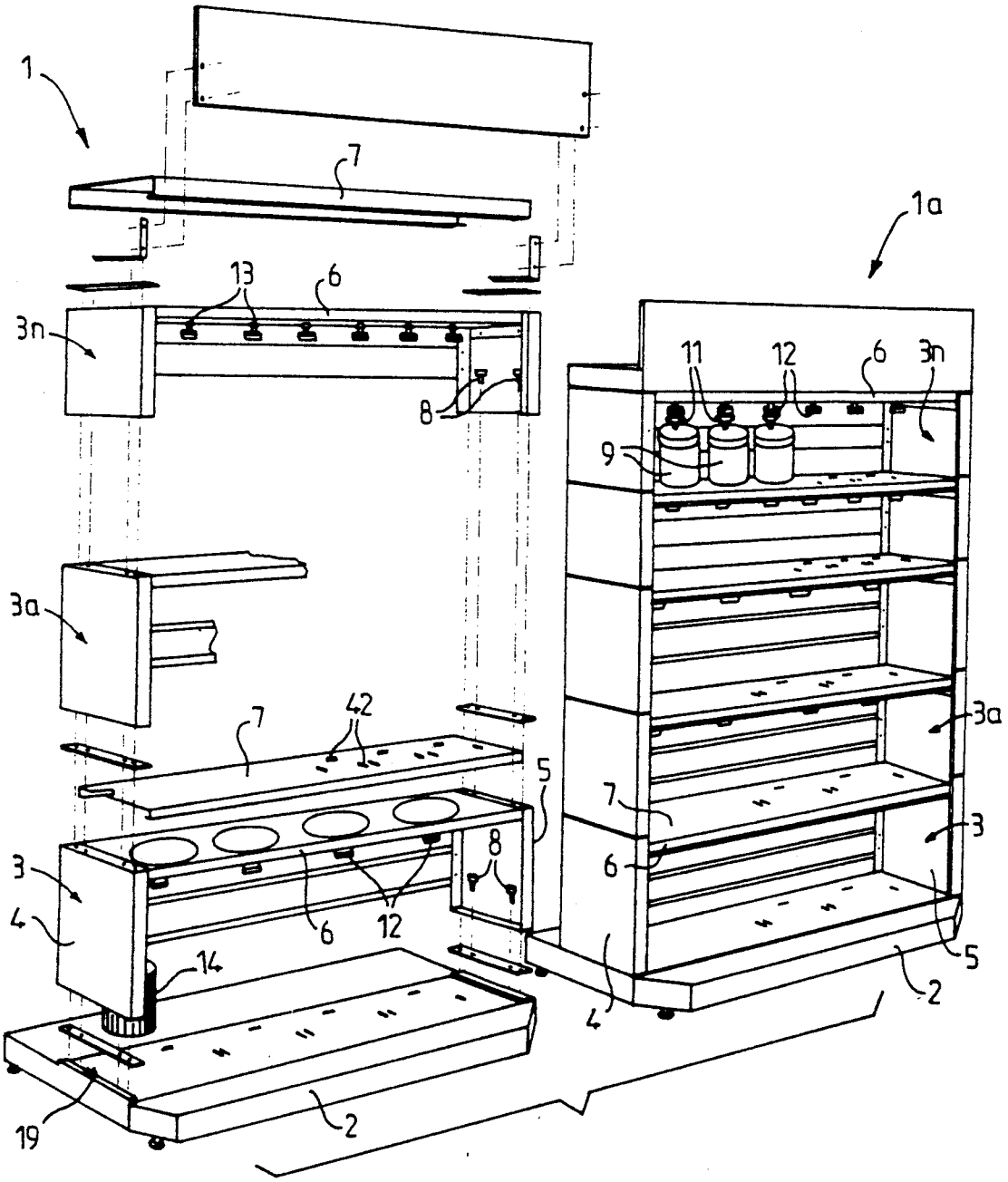
FIG. 1 is a partly broken away perspective view of stirrer modules according to the invention for the mixing of paints.

Referring now to the drawings, FIG. 1 shows, at a right hand side thereof, a module 1, the parts of which have been broken away and, at the left hand side thereof, a module 1*a* which is completely mounted and provided to be connected adjacent to the module 1 for making a two module cabinet of a so-called modular structure.

As this is shown from the present disclosure, a cabinet may be formed by a single module or by any number of modules.

Each module comprises a base 2 for supporting a plurality of superimposed cells 3, 3*a*, . . . 3*n*, each cell being made in a similar manner and comprising two vertical panels 4, 5 connected, at their upper part, by means of a plate 6 provided for supporting a mechanism hereinafter described and which is covered with a cover 7. The cover 7 forms also the bottom of an upper cell, in the present case the bottom of the cell 3*a*.

The following disclosure shows that a given module may comprise any number of cells, for example five or six.

The operation for assembling the vertical panels 4, 5 on the base 2, then the plate 6 and the cover 7 forming the bottom of a upper cell, is not described in detail since it can be made in various ways.

In a general manner, the vertical panels are made of a bent iron sheet and the assembling is made by means of bolts, such as the bolts shown at 8. Similar bolts 8 can also be used for fixing the plate 6 and its cover 7.

The part of each cover 7 which forms the bottom of a cell is provided for supporting stirrer cans 9 having a cover 10 which comprises a coupling member 11 provided to engaged with a complementary coupling member 12 carried and driven by a shaft 13 protruding from the underside of each plate 6.

The complementary coupling elements 11 and 12 being well known in the art of stirrers for paint packaged in cans, they are not described in more detail in the following disclosure.

Only the driving operation of the shaft 13 is explained as an example in the following disclosure in reference with FIG. 5.

Figures 2, 3:
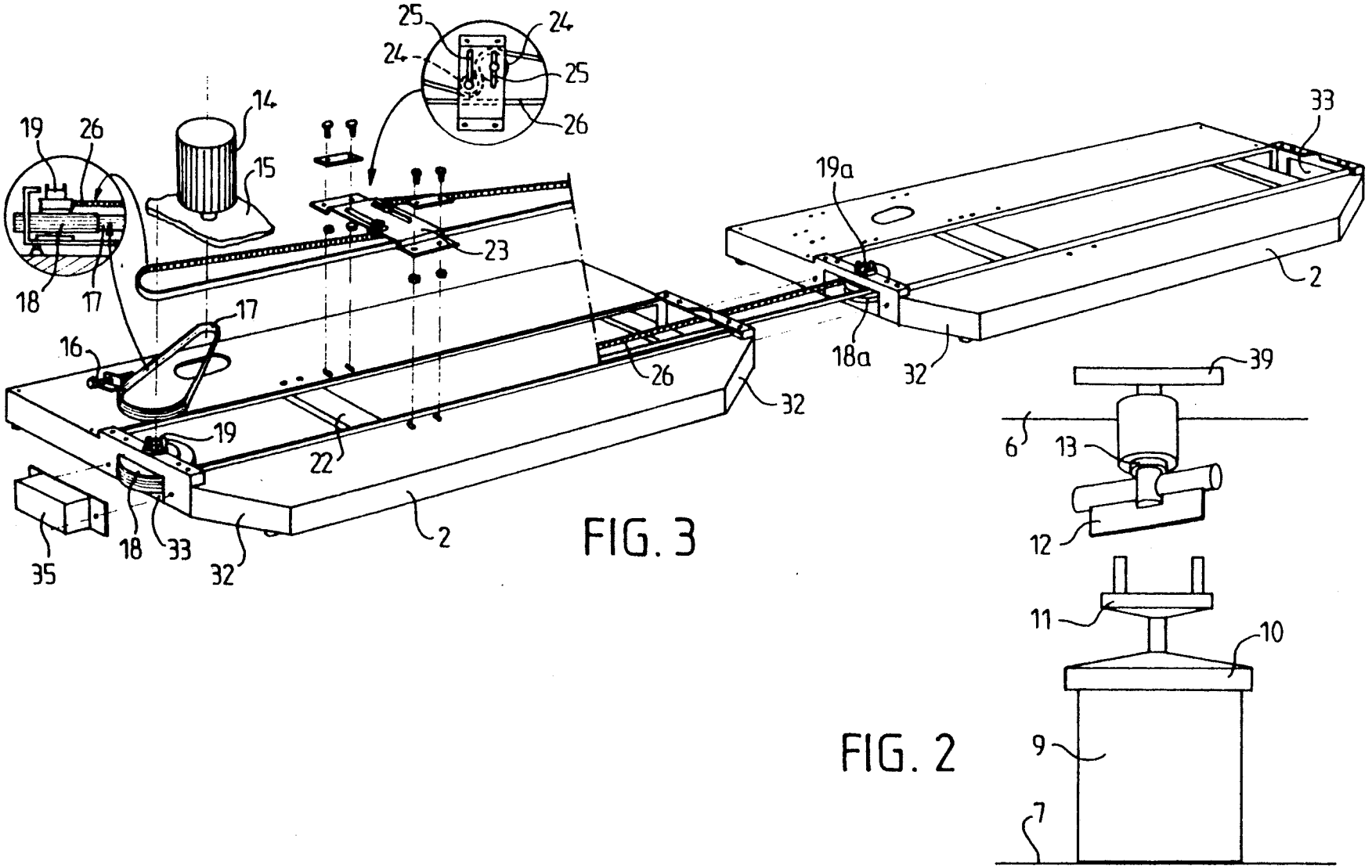
FIG. 2 is a broken away perspective view of a detail of embodiment shown in FIG. 1.
FIG. 3 is a broken away perspective view of a motor and transmitter mechanism included in a base of the stirrer modules.

In the embodiment of FIGS. 1–4, one of the bases 2 is provided with an electric motor reducing unit 14 (FIG. 1) carried by a plate 15, the position of which can be adjusted by a suitable mechanism, for example a screw 16 (FIG. 3). The motor reducing unit 14 is provided for driving a belt 17 or the like with belt 17, travelling on a two groove pulley 18 mounted in the base 2 near one of its lateral sides.

Figure 6:
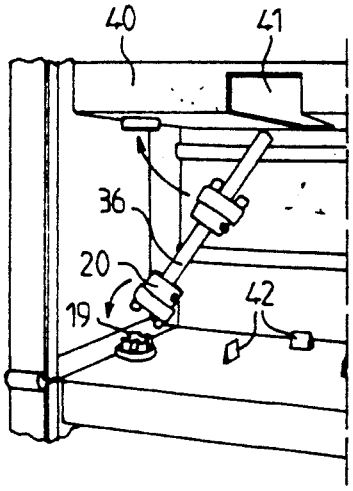
FIG. 6 is a broken away perspective view of a shaft device forming a vertical transmitter for driving the mechanisms contained in the plates of the cells.

The pulley 18, which is housed in a thickness of the base 2, is connected to a vertical coupling member 19, for example of the pin type as shown in FIG. 6, and which is provided for driving a second coupling member 20 of a same type, possibly through an elastic coupling.

The base 2 inwardly comprises cross members 22, 23 supporting therebetween a set of pulleys 24 (FIG. 3*b*), which are adjustable in position with respect to slots 25 for enabling an adjustment in tension of a toothed belt 26 or the like. The toothed belt 26 is passed in the second groove of the pulley 18 of the first base 2 and in one of the two grooves of a pulley 18*a* similar to the pulley 18 and mounted in the same manner near one lateral end of a second base 2, the pulley 18*a* comprising also a vertical coupling member 19*a*.

It results from the above disclosure that the movement of the motor reducing unit 14 can easily be transmitted from one base 2 to another base 2 by means of the toothed belts 26, which are all alike when length of the bases 2 is the same for all the modules 1.

Figure 4:
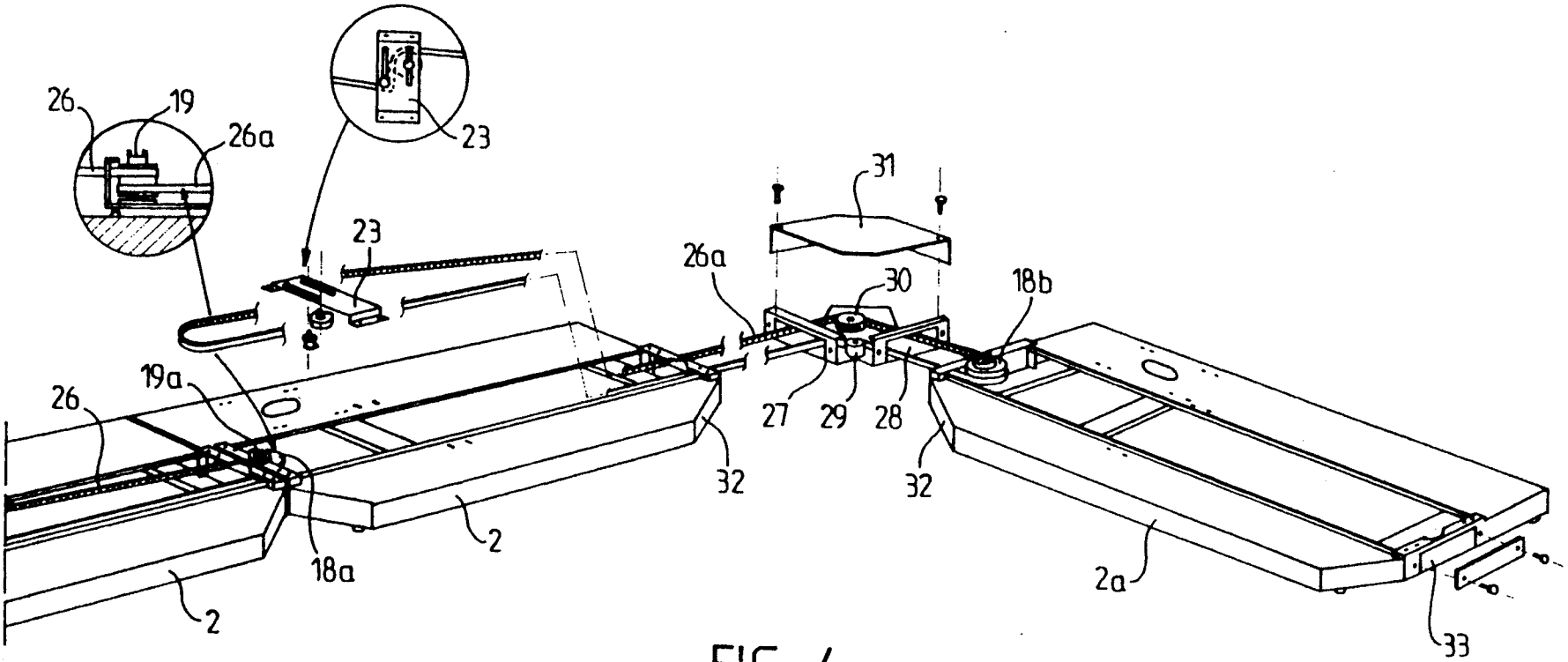
FIG. 4 is a broken away perspective view similar to FIG. 3 and showing two modules placed at right angle.

When two bases 2, 2*a* must be installed at right angle, there is placed, therebetween and as shown in FIG. 4, a bevel gear 27 which is made by a casing 28 in which are provided pulleys 29, 30 for a toothed belt 26*a* for connecting, for example, the two groove pulley 18*a* to another two groove pulley 18*b* mounted in the base 2*a*.

The casing 28 is covered with a cap 31.

For permitting a disposition of the bases 2, 2*a* in a line or at a right angle, or still according to an other angle, the drawing shows that it is advantageous that the angles of the bases 2, 2*a* will be bevelled as shown at 32.

For enabling passing the belts 26, 26*a*, the ends of the bases 2, 2*a* are provided with apertures 33, with these apertures 33 being closed, for the end bases, by a plate 34 or a casing 35.

Actually, it is advantageous for obtaining a suitable reduction ratio that the two groove pulley 18 of the first base, i.e. the base which is provided with a motor 14, will have two steps and be slightly protruding from the base 2, as shown in FIG. 3, so that the coupling member 19 will be aligned with the volume inwardly delimited by the first vertical panel 3 in which the vertical coupling member 19 will enter.

The above arrangement provides that the second coupling member 20 (FIG. 6) can be positioned on the protruding part of the coupling member 19, this second coupling member 20 being connected to a shaft 36 driving the coupling members 20*a* and 19*a*. The coupling member 19*a* is connected to a pulley 37 installed in the first plate 6 (FIG. 5).

Figure 5:
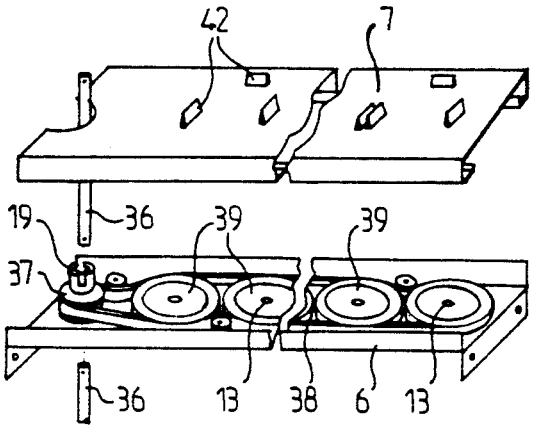
FIG. 5 is a broken away perspective view showing the driving mechanism contained in the plates of the cells constituting the modules of FIG. 1.

The pulley 37 drives a belt 38 or like member engaged with pulleys 39 mounted on each of the shafts 13 which have been previously described and which are shown in FIGS. 1 and 5.

The above disclosure shows that the two groove pulley 18 of each base 2, 2*a* makes possible, by means of vertical coupling members, for example of the pin type, and with shaft lengths which can easily be mounted, to drive sets of transmission units formed by a driving pulley 37 and driven pulleys 39, included in a plate 6 of a cell, and that a plurality of cells can thus be superimposed, at the user's will, all the cells being identical each other.

Figure 7:
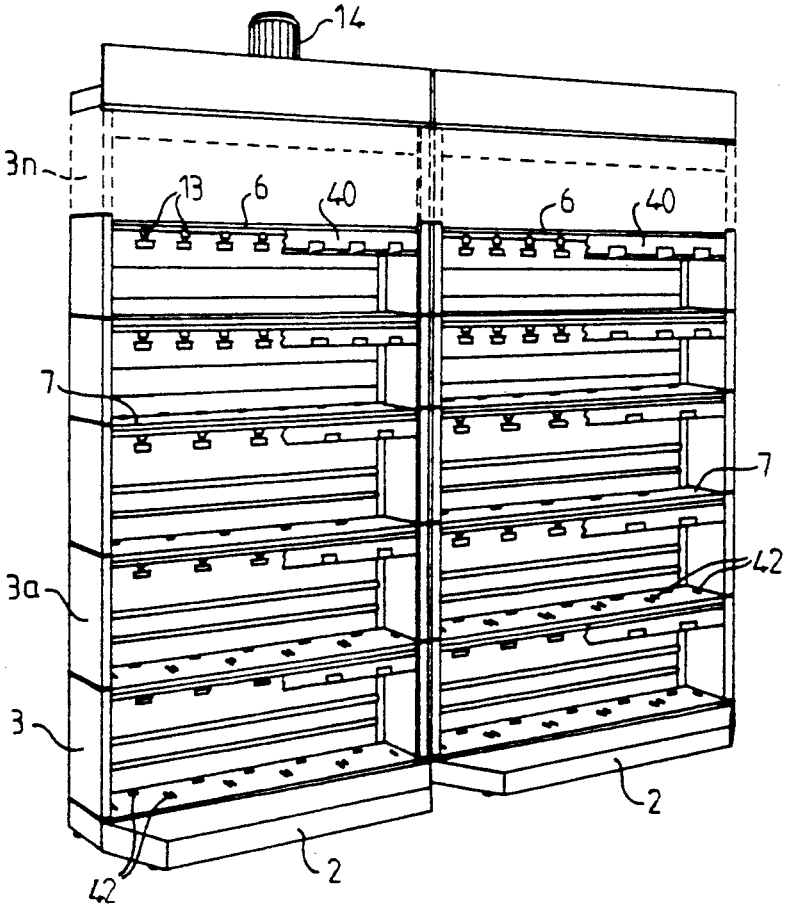
FIG. 7 is a perspective view of stirrer modules according to a slight variant of embodiment.

In the above embodiment, the motor reducing unit is installed on the base 2, behind the first cell 3. In some cases, it may be advantageous to reduce the thickness of the modules, which is shown in FIG. 7 in which the motor reducing unit 14 is positioned at the very top of the module. The mechanisms described with reference to FIGS. 3 and 4 are then included in a box made in a similar manner as the base 2, but positioned on the last cell 3*n*.

Although this has not been shown, transmission of one cell to another cell is made in the same manner as described with reference to FIGS. 1–6.

In addition to the preceeding disclosure, it is advantageous, as illustrated in particular in FIGS. 6 and 7, that a casing 40 will be positioned under each plate 6 in order to isolate the coupling members 12.

Each casing 40 comprises an aperature 41 for introducing the coupling member 11 provided on the cover of each stirrer can 9, the centering of which is provided by fingers 42 (FIG. 6) protruding from the cover 7 covering the plates 6 and forming the bottom of a cell. There is thus made sure that accidents caused by a rotation of the coupling members 12 are eliminated, since the coupling members 12 are not apparent even when a cell is not completely filled with stirrer cans.

The invention is not restricted to the embodiments shown and described in detail since various modifications thereof can be applied thereto without departing from its scope. In particular, in the case of great sized cabinets, it is possible to provide a plurality of modules comprising a motor 14.

What is claimed is:

1. A cabinet system for storing and stirring of products packaged in cans having a can stirrer comprising:

two contiguous modules, each of said modules including a vertically short, flat base having a flat top surface, a first discrete modular cell mounted on said base and at least two discrete superimposed modular cells mounted on said first cell, each of said discrete modular cells having a generally rectangular parallelepiped configuration with an open front and an open bottom, and including (a) two vertical side panels, (b) a top plate enclosure connecting upper portions of said vertical panels and having a flat top surface, (c) can coupling members depending from said top plate enclosure which are respectively and complementarily connected to a respective can stirrer of a respective can resting on a lower adjacent said top surface, and (d) respective driving mechanisms to which respective said can coupling members are connected and which are contained in said top plate enclosure for driving said can coupling members, said first cell having (a) respective assembly means for attaching respective said vertical panels of said first cell to said base, and (b) a vertical transmitting unit extending from said top plate enclosure toward said base, each of said superimposed cells having (a) respective assembly means for attaching respective said vertical panels of said superimposed cells to a lower and adjacent said cell, and (b) a vertical transmitting unit extending from said top plate enclosure which is adapted to connect with said vertical transmitting unit of a lower said top plate enclosure;

a single motor reducing unit provided adjacent only one of said cells of only one of said modules, and connected to said vertical transmitting unit of said one of said cells of said one of said modules; and a horizontal transmitting unit in said one of said modules connected to said motor reducing unit for transmitting movement of said motor reducing unit horizontally to one of said vertical transmitting units of a horizontally adjacent said cell of the other said contiguous module.

2. The cabinet as set forth in claim 1, wherein each said vertical transmitting unit comprises a main pulley ultimately connected to said motor reducing unit, a plurality of vertical coupling members of which one is coupled to said main pulley, and associated shaft lengths provided between adjacent said vertical coupling members and with one of said shaft lengths extending from a lower one of said modular cells to an upper one of said modular cells such that rotation of said main pulley by said motor reducing unit causes rotation of said coupling members and shaft lengths.

3. The cabinet as set forth in claim 2, wherein said horizontal movement transmitting unit comprises a second pulley of the other of said contiguous modules and a horizontal transmission belt driven by said main pulley providing a connection between said main pulley and said second pulley of the other of said contiguous modules.

4. The cabinet as set forth in claim 2, wherein said vertical coupling members are of the pin type.

5. The cabinet as set forth in claim 2, wherein each said top plate enclosure comprises a series of driven pulleys, a belt for driving said series of driven pulleys, a driving pulley connected to an associated said coupling member of an associated said shaft length for driving said belt when said shaft lengths and coupling members are rotated, a respective shaft to which a respective said driven pulley is mounted and to which in turn is connected a respective said can coupling member for a respective can stirrer of a respective can.

6. The cabinet as set forth in claim 3, wherein two of said modules are arranged contiguously while forming an angle therebetween; and wherein said horizontal transmitting unit further comprises a bevel gear mechanism for the belt, said bevel gear mechanism being interposed between said two contiguously arranged modules.

7. The cabinet as set forth in claim 3, wherein said first cell includes an inside area adjacent one of said two vertical panels; and wherein said main pulley as well as said second pulley are each two groove pulleys which are placed so that an associated said vertical coupling member protrudes into said inside area of the adjacent one of said vertical panels.

8. The cabinet as set forth in claim 3, wherein each said base includes a space and adjustable pulleys in said space such that respective said horizontal transmission belts are positioned in respective said spaces of said bases in engagement with respective said pulleys which are adjustable in position for modifying a tension of respective said belts.

9. The cabinet as set forth in claim 1, wherein each said top surface includes centering fingers for the cans provided on said top surfaces.

10. The cabinet as set forth in claim 9, wherein said top plate enclosure of each of said cells has a bottom part including a casing having apertures therein for introduction of the associated said can stirrer of each can centered by said fingers formed on said top surface of a lower said cell.

11. The cabinet as set forth in claim 1, wherein said bases are bevelled, at adjacent corners thereof.

12. The cabinet as set forth in claim 1, wherein said motor reducing unit is mounted on a said base.

13. The cabinet as set forth in claim 1, wherein an upper cell includes a box and said motor reducing unit is mounted on said box carried by said upper cell.

14. A cabinet system for storing and stirring of products packaged in cans having a can stirrer comprising:

two contiguous modules forming an angle therebetween, each of said modules including a vertically short, flat base having a flat top surface, a first discrete modular cell mounted on said base and at least two discrete superimposed modular cells mounted on said first cell, each of said discrete modular cells having a generally rectangular parallelepiped configuration with an open front and an open bottom, and including (a) two vertical side panels, (b) a top plate enclosure connecting upper portions of said vertical panels and having a flat top surface, (c) can coupling members depending from said top plate enclosure which are respectively and complementarily connected to a respective can stirrer of a respective can resting on a lower adjacent said top surface, and (d) respective driving mechanisms to which respective said can coupling members are connected and which are contained in said top plate enclosure for driving said can coupling members, said first cell having (a) respective assembly means for attaching respective said vertical panels of said first cell to said base, and (b) a vertical transmitting unit extending from said top plate enclosure toward said base, each of said superimposed cells having (a) respective assembly means for attaching respective said vertical panels of said superimposed cells to a lower and adjacent said cell, and (b) a vertical transmitting unit extending from said top plate enclosure which is adapted to connect with said vertical transmitting unit of a lower said top plate enclosure;

a single motor reducing unit provided adjacent only one of said cells of only one of said modules, and connected to said vertical transmitting unit of said one of said cells of said one of said modules; and a horizontal transmitting unit in said one of said modules connected to said motor reducing unit for transmitting movement of said motor reducing unit horizontally to one of said vertical transmitting units of a horizontally adjacent said cell of the other said contiguous module, said horizontal transmitting unit including a bevel gear mechanism interposed between said contiguous modules.

* * * * *